US012059768B2

(12) United States Patent
Nowak et al.

(10) Patent No.: US 12,059,768 B2
(45) Date of Patent: Aug. 13, 2024

(54) BLOCKING PIECE AND METHOD FOR VACUUM BLOCKING A LENS BLANK

(71) Applicants: Carl Zeiss Vision International GmbH, Aalen (DE); OptoTech Optikmaschinen GmbH, Wettenberg/Launsbach (DE)

(72) Inventors: Gerd Nowak, Neresheim (DE); Wito Hartmann, Aalen (DE); Roland Mandler, Wettenberg (DE); Oswin Lack, Hüttenberg-Weidenhausen (DE)

(73) Assignees: Carl Zeiss Vision International GmbH, Aalen (DE); Opto Tech Optikmaschinen GmbH, Wettenberg/Launsbach (DE)

( * ) Notice: Subject to any disclaimer, the term of this patent is extended or adjusted under 35 U.S.C. 154(b) by 0 days.

(21) Appl. No.: 18/049,699

(22) Filed: Oct. 26, 2022

(65) Prior Publication Data

US 2023/0075451 A1 Mar. 9, 2023

Related U.S. Application Data

(63) Continuation of application No. PCT/EP2022/051964, filed on Jan. 27, 2022.

(30) Foreign Application Priority Data

Jan. 28, 2021 (EP) ..... 21154058

(51) Int. Cl.
*B24B 13/005* (2006.01)

(52) U.S. Cl.
CPC ..... *B24B 13/005* (2013.01); *B24B 13/0052* (2013.01); *B24B 13/0055* (2013.01)

(58) Field of Classification Search
CPC ..... B24B 13/005; B24B 13/0052; B24B 13/0055
(Continued)

(56) References Cited

U.S. PATENT DOCUMENTS 2,395,700 A * 2/1946 Walker ..... B24B 13/005 451/388
2,688,220 A * 9/1954 Boutell ..... B24B 13/005 451/388
(Continued)

FOREIGN PATENT DOCUMENTS

CN 104768708 A 7/2015
CN 112166007 A 1/2021
(Continued)

OTHER PUBLICATIONS

International Search Report and Written Opinion by the International Searching Authority in PCT/EP2022/051964, to which this application claims priority, mailed Mar. 23, 2022.
(Continued)

*Primary Examiner* — Eileen P Morgan
(74) *Attorney, Agent, or Firm* — Tautz & Schuhmacher LLC; Georg Hasselmann

(57) ABSTRACT

A blocking piece for vacuum blocking a lens blank is disclosed. The blocking piece includes a blank contacting element formed of a rigid fluid-permeable material having an upper surface for contacting the lens blank. The blocking piece further includes a support element having an upper part tightly enclosing the blank contacting element on a peripheral surface of the blank contacting element and a lower part adapted to engage with a clamping device for clamping the blocking piece. The lens blank is fixed to the upper surface of the blank contacting element by applying a vacuum within the blocking piece to provide suction through essentially the entire upper surface of the blank contacting
(Continued)

element. The disclosure further relates to a method for blocking a lens blank and a use of an element formed of a rigid fluid-permeable material as a part of a blocking piece.

18 Claims, 3 Drawing Sheets

(58) Field of Classification Search
USPC ..... 451/42, 384, 388, 390
See application file for complete search history.

(56) References Cited

U.S. PATENT DOCUMENTS

| | | | | |
|---|---|---|---|---|
| 2,958,162 | A * | 11/1960 | Upton | C03B 23/22 65/38 |
| 3,134,208 | A | 5/1964 | Richmond | |
| 3,794,314 | A * | 2/1974 | Coburn | B24B 13/005 269/21 |
| 3,874,127 | A * | 4/1975 | Coburn | B25B 11/007 451/390 |
| 4,089,102 | A * | 5/1978 | Soper | B24B 13/005 29/559 |
| 4,184,292 | A | 1/1980 | Defazio et al. | |
| 5,291,692 | A * | 3/1994 | Takahashi | B24B 13/005 451/388 |
| 5,505,654 | A * | 4/1996 | Wood | B24B 13/0052 451/6 |
| 6,089,713 | A | 7/2000 | Hof et al. | |
| 6,224,467 | B1 | 5/2001 | Tanaka et al. | |
| 9,381,604 | B2 | 7/2016 | Schneider et al. | |
| 9,415,478 | B2 | 8/2016 | Castro et al. | |
| 2002/0159027 | A1 | 10/2002 | Tai | |
| 2007/0229756 | A1 | 10/2007 | Mandler et al. | |
| 2008/0051017 | A1 | 2/2008 | Jiang et al. | |
| 2011/0097484 | A1* | 4/2011 | Sakai | G02B 1/12 269/21 |
| 2014/0329443 | A1* | 11/2014 | Savoie | B24B 9/146 451/390 |
| 2015/0309217 | A1 | 10/2015 | Castro et al. | |
| 2016/0052101 | A1* | 2/2016 | Misaka | B24B 13/005 451/388 |
| 2020/0301168 | A1 | 9/2020 | Traina et al. | |
| 2021/0001579 | A1 | 1/2021 | Meschenmoser et al. | |
| 2023/0075451 | A1* | 3/2023 | Nowak | B24B 13/005 |

FOREIGN PATENT DOCUMENTS

| | | | |
|---|---|---|---|
| DE | 2531134 | A1 | 1/1976 |
| DE | 3924078 | A1 | 1/1991 |
| DE | 102005038063 | A1 | 2/2007 |
| EP | 897777 | A2 | 2/1999 |
| EP | 2266754 | B1 | 8/2016 |
| JP | 03121763 | A | 5/1991 |
| JP | 1999-048002 | A | 2/1999 |
| JP | 2002086327 | A | 3/2002 |
| JP | 2003340665 | A | 12/2003 |
| JP | 2004-524177 | A | 8/2004 |
| JP | 201522645 | A | 12/2015 |
| KR | 10-2006-0054441 | A | 5/2006 |
| KR | 10-2015-0079617 | A | 7/2015 |
| WO | 2009/119348 | A1 | 10/2009 |
| WO | WO-2017046803 | A1 * | 3/2017 |

OTHER PUBLICATIONS

Office Action issued in CN 202280004111.2, mailed on May 4, 2023, and English-language translation thereof.

Intention to Grant issued in EP 22 701 996.5, mailed on May 17, 2023.

Office Action issued in KR 10-2023-7004717, mailed on Jul. 1, 2023, and English-language translation thereof.

Office Action issued in MX/a/2022/015730, which is a counterpart hereof, mailed on Jul. 18, 2023, and English-language translation thereof.

Intention to Grant (Communication under Rule 71(3) EPC) issued in EP 22 701 996.5, which is a counterpart hereof, mailed on Oct. 6, 2023.

Decision to grant issued in CN 202280004111.2, which is a counterpart hereof, mailed on Sep. 24, 2023, and English-language translation thereof.

International Preliminary Report on Patentability issued in PCT/EP2022/051964, to which this application claims priority, mailed Aug. 10, 2023 (In the English language).

Office Action issued in JP 2022-570588, which is a counterpart hereof, mailed on Jul. 19, 2023, and English-language translation thereof.

Notice of Allowance issued in MX/a/2022/015730, which is a counterpart hereof, mailed on Jan. 16, 2024, and English-language translation thereof.

Notice of Allowance issued in KR 10-2023-7004717, which is a counterpart hereof, mailed on Jan. 31, 2024, and English-language translation thereof.

Office Action issued in KR 10-2023-7004717, which is a counterpart hereof, mailed on Nov. 1, 2023, and English-language translation thereof.

* cited by examiner

BLOCKING PIECE AND METHOD FOR VACUUM BLOCKING A LENS BLANK

CROSS REFERENCE TO RELATED APPLICATIONS

This application is a continuation application of international patent application PCT/EP2022/051964, filed Jan. 27, 2022, designating the United States and claiming priority from European application EP 21154058.8, filed Jan. 28, 2021, and the entire content of both applications is incorporated herein by reference.

TECHNICAL FIELD

Exemplary embodiments of the disclosure relate to a blocking piece for vacuum blocking a lens blank, a method for blocking a lens blank to a blocking piece, and a use of an element formed of a rigid fluid-permeable material as a part of a blocking piece. The exemplary embodiments are, thus, related to systems, devices, and methods for blocking lens blanks and for manufacturing ophthalmic lenses, in particular spectacle lenses.

BACKGROUND

For an industrial mass production of spectacle lenses made of plastic materials or mineral glass, particularly for spectacle lenses having a freeform surface, the lens blanks are blocked by a blocking piece using a device, which may be referred to as a blocking device, separate from the machining device for grinding or cutting the lens blanks. Blocking the lens blank is necessary to fixate the lens blank in a defined position and in a mechanically resilient manner sustaining the milling or grinding process for individualizing the refractive power of the lens blank. The blocking piece, by which a lens blank is blocked, allows clamping the lens blank via the blocking piece in a form-fitting and/or force-fitting manner to the grinding or cutting machine.

According to the related art, the lens blank is attached to the blocking piece using a metallic alloy having a low melting temperature. The lens blank is positioned relative to the blocking piece with the finished front surface of the lens blank facing the blocking piece such that the surface normal of the lens blank and the surface normal of the blocking piece are positioned in a predetermined angle relative to each other and the space in between the blocking piece and the front surface of the lens blank is filled with the liquid metallic alloy. Afterwards, the blocking piece is cooled down by a cooling device integrated into the blocking device to harden the metallic alloy and by this to fix the lens blank to the blocking piece. This blocking method may be carried out manually or in an automated manner. After the metallic alloy is hardened, the blocking piece and the lens blank attached to it may be removed from the blocking device.

After the blocking step, the following manufacturing steps are typically carried out on the blocked lens blank: cutting the marginal contour of the spectacle lens, milling the intended refractive power into the back surface of the lens blank, polishing the milled surface by a polishing device, into which the blocked lens blank is inserted, and applying signature marks at the optical surface allowing an exact positioning of the optical surface.

Finally, the finished spectacle lens is removed from the blocking piece. In case of a metallic alloy used for blocking, the metallic alloy is heated, molten, and submitted to a recycling process.

Using a metallic alloy for blocking lens blanks comes along with environmental disadvantages. Therefore, there have been attempts for environmental reasons to refrain from using a metallic alloy for blocking lens blanks. An alternative blocking method is described in DE 102005038063 A1, which suggests using a polymeric adhesive or a thermoplastic material, which can be cured by light irradiation.

In case of using a polymeric or thermoplastic material for blocking, submitting the blocking material after unblocking to a reuse of the blocking material often is economically not feasible due to contaminations of the blocking material during the manufacturing process and due to mechanical and/or chemical alterations of the material properties coming along over time.

An alternative approach for blocking a lens blank suggested in the related art is described in EP 2266754 B1. This suggested method uses a blocking piece having a supporting surface comprising ring-shaped recesses to fix the lens blank to the supporting surface by means of a vacuum. This approach, however, often leads to undesired deformations of the lens blank due to the recesses.

JPH-03121763A describes a vacuum adapter having several interdigitating cylindrical parts. DE2531134A1 depicts a vacuum adapter, wherein the lens is contacted by flexible sealing rings. U.S. Pat. No. 3,134,208A shows a vacuum adapter having circular recesses, which may be evacuated. Further vacuum adapters are described in U.S. Pat. No. 4,089,102A and DE3924078A1.

EP0897777A2 describes a blocking piece with an opening in the center to hold a lens blank. U.S. 2002/159027A1 describes a holding device in which a lens to be processed is fixed to the holding device by means of two magnetic elements in order to process the edge of the lens. U.S. Pat. No. 4,184,292A describes a conventional blocking piece for vacuum blocking, where the blocking piece is provided with a spring-loaded valve. U.S. 2011/097484A1 describes a holding section made of an elastomeric material. U.S. 2008/051017A1 describes a foil applied for protecting a lens during processing.

SUMMARY

It is, thus, desirable to provide methods and devices for blocking lens blanks not exhibiting the disadvantages of the conventional devices and methods.

This problem is solved by exemplary embodiments of the disclosure. Exemplary embodiments of the disclosure relate to a blocking piece for vacuum blocking a lens blank, a method for blocking a lens blank to a blocking piece and a use of an element formed of a rigid fluid-permeable material as a part of a blocking piece. Exemplary embodiments are discussed in detail in the following description.

One exemplary embodiment relates to a blocking piece for vacuum blocking a lens blank. The blocking piece comprises a blank contacting element formed of a rigid fluid-permeable material having an upper surface for contacting the lens blank. The blocking piece further comprises a support element having an upper part tightly enclosing the blank contacting element on a peripheral surface of the blank contacting element and a lower part adapted to engage with a clamping device for clamping the blocking piece. The blocking piece is adapted to fix the lens blank to the upper surface of the blank contacting element by applying a vacuum within the blocking piece to provide a suction through essentially the entire upper surface of the blank contacting element to suck the lens blank to the upper surface of the blank contacting element.

Another exemplary embodiment relates to a method for blocking a lens blank to a blocking piece. The method comprises a step of providing a blocking piece having a blank contacting element formed of a rigid fluid-permeable material, the blank contacting element having an upper surface for contacting the lens blank, wherein the blank contacting element is tightly enclosed by a support element on a peripheral surface of the blank contacting element. The method further comprises a step of arranging the lens blank at the upper surface of the blank contacting element such that the lens blank entirely covers the upper surface. Moreover, the method comprises a step of applying a vacuum within the blocking piece to provide suction through the rigid fluid-permeable material sucking the lens blank to the entire upper surface of the blank contacting element.

Yet another exemplary embodiment relates to a use of an element formed of a rigid fluid-permeable material as a part of a blocking piece to block a lens blank to the blocking piece by applying a vacuum within the blocking piece to suck the lens blank to the element formed of a rigid fluid-permeable material. Yet another exemplary embodiment relates to a use of a blocking piece according to the present disclosure for blocking a lens blank by applying a vacuum within the blocking piece to suck the lens blank to the blank contacting element formed of a rigid fluid-permeable material.

A lens blank may relate to an unprocessed precursor of a spectacle lens, such as a lens blank having an unprocessed front surface and an unprocessed back surface. The lens blank may be provided in a molding process. The lens blank may, however, also relate to a partly processed precursor of a spectacle lens. For instance, the lens blank may have a front surface which is partly or fully processed, and which may be covered with a protective foil or coating.

A blocking piece relates to an adapter piece for mounting a lens blank into a processing device, in particular a processing device for machining and/or grinding and/or cutting and/or polishing the back surface of the lens blank according to prescription data and/or for edging the spectacle lens according to provided edging data. On one side, the blocking piece is adapted to contact a lens blank and, on another side, the blocking piece is adapted to engage in a processing device for processing the lens blank. The blocking piece is adapted to allow reversible blocking of a lens blank, wherein the blocked lens blank may be unblocked in a manner maintaining the integrity of the lens blank and in particular of the front surface of the lens blank, which may optionally be protected by a protective foil or coating.

The blank contacting element being fluid-permeable means that a fluid stream of gas, in particular a stream of air, may be generated through the blank contacting element. In particular, a suction may be generated through the blank contacting element by applying a pressure difference between the outside and the inside of the blocking piece. The blank contacting element being rigid means that no deformation of the blank contacting element occurs due to the regular mechanical impact on the blank contacting element to be expected during blocking and/or unblocking. In other words, the blank contacting element being rigid means that the blank contacting element has a hardness and/or stiffness to maintain its shape when subjected to its use in a blocking piece.

The support element "tightly enclosing" the blank contacting element on a peripheral surface of the blank contacting element means that the support element tightly seals at least the peripheral surface of the blank contacting element. In other words, no gas or air stream may enter or exit the peripheral surface of the blank contacting element when tightly enclosed by the support element.

A suction through "essentially the entire upper surface" of the blank contacting element means that the suction and the possible air flow resulting from the suction is not restricted to certain minor sub-areas of the upper surface of the blank contacting element, such as delimited recesses or holes provided at the upper surface of the blank contacting element. Instead, "essentially the entire upper surface" means that the suction is provided over a major part of the upper surface, in particular over an area of more than 90% of the accessible part of the upper surface and preferably over the entire accessible upper surface. A part of the upper surface being accessible means that the part of the upper surface is not covered, for instance by the support element, but accessible to be contacted by the lens blank.

The term "vacuum" relates to a pressure being well below the surrounding atmospheric pressure. A vacuum in this sense, however, does not require the entire absence of matter, as may be inferred from a strict scientific definition. Instead, a pressure reduced by at least 0.3 bar, optionally at least 0.5 bar, optionally at least 0.7 bar and optionally at least 0.8 bar relative to the atmospheric pressure (i.e., a total pressure of 0.7 bar, 0.5 bar, 0.3 bar, and 0.2 bar, respectively) is considered as a vacuum within the meaning of the description.

The disclosure provides the advantage that a homogeneous pressure distribution or force distribution may be provided over the upper surface of the blank contacting element for contacting a lens blank to the blank contacting element by means of a vacuum. This reduces the risk of deformations of the lens blank due to inhomogeneities of the pressure distribution, as they regularly occur when using blocking pieces providing a vacuum in restricted sub-areas, such as delimited recesses or holes. Therefore, the disclosure provides the advantage that a high suction force may be applied to the lens blank and, thus, a strong stabilization force may be applied to the lens blank during blocking without the danger of local pressure variations inflicting local deformations of the lens blank.

The disclosure provides the further advantage that no metallic alloy is required for attaching the lens blank to the blocking piece and, thus, the environmental compatibility of the blocking process can be improved and the costs may be reduced. Moreover, no recycling of such a metallic alloy is required, which further reduces the costs of the blocking process. Even if compared to conventional blocking methods using polymeric and/or thermoplastic materials, the recycling effort cane be significantly reduced or completely avoided.

The disclosure provides yet the further advantage that no heating and cooling of a blocking adhesive, such as a metallic alloy, is required for blocking and unblocking the lens blank. Therefore, the energy consumption of the blocking process can be reduced. Moreover, since no heating and cooling steps are required, no respective waiting time is required, which is conventionally required to allow the lens blank and the blocking piece reaching the desired temperature. Consequently, the disclosure allows a reduction of the required time effort for the blocking and/or unblocking of a lens blank.

Moreover, the disclosure provides the further advantage that no heat input is required for blocking and/or unblocking a lens blank, as for instance required when using a metallic alloy and/or plastic materials. Therefore, undesired deformations of the lens blanks due to the heat unput, in particular of lens blanks made of plastic materials, can be avoided, which often result in deviations of the lens shape from the intended shape.

According to an exemplary embodiment, the rigid fluid-permeable material comprises or consists of a rigid porous material having an open porosity. The porosity may comprise a micro-porosity, a meso-porosity and/or a macro-porosity. The open porosity, also referred to as effective porosity, of the blank contacting element is considered to represent the porosity available to contribute to fluid flow through the blank contacting element. In other words, the open porosity specifies the ability of the blank contact element (or a work piece in general) to conduct a fluid flow through the blank contact element. In general, only an open pore volume is available to contribute to fluid flow, since entirely closed pores cannot be accessed by the fluid and, thus, can neither be evacuated nor vented. Accordingly, the open porosity ($\Phi_f$) is typically specified as a ratio of the pore volume contributing to fluid flow ($V_f$) over the total pore volume ($V_{tot}$):

$$\Phi_f = \frac{V_f}{V_{tot}}.$$

The open porosity of the rigid fluid-permeable material may be in a range from 1% to 90%, optionally from 1.5% to 50%, optionally from 2% to 20% and optionally from 10% to 15%. In general, a low open porosity may result in a high rigidity and mechanical stability and a high open porosity may result in a high permeability for fluid flow. The material may, thus, be chosen with respect to its open porosity according to a trade-off between mechanical stability and fluid-permeability. An open porosity between 2% and 10% may be a suitable range for most blocking applications. The open porosity may be determined by various techniques. Optionally, the open porosity of micro- and meso-porous materials may be determined by nitrogen sorption measurements. The open porosity of macro-porous materials may be determined by a fluid saturation measurement according to the Archimedes' principle, in particular by a water saturation measurement determining the ability of the work piece under investigation to adsorb water. The porosity of the material has the beneficial effect that it provides a large number of microscopically small contact areas in which the vacuum and, hence, the pressure is applied to the lens blank, wherein the large number of contact areas is statistically distributed over the whole upper surface of the blank contacting element. This avoids the above-mentioned undesired deformations due to only few macroscopic recesses, in which the vacuum is applied, as known in the related art.

According to an exemplary embodiment the rigid fluid-permeable material comprises or consists of one or more of the following materials: ceramic materials, carbide materials, in particular silicon carbide, oxide materials, in particular aluminum oxide, and aluminum foam. These materials provide the advantage that they intrinsically exhibit an open porosity or may be manufactured to exhibit an open porosity. In addition, these materials provide the advantage that they exhibit a high rigidity and, thus, have a high stability under pressure. Therefore, these materials offer a suitable combination of fluid-permeability and mechanical stability, which makes them suitable materials for a use in a blank contacting element. For example, a porous material having a certain degree of (open) porosity may be used, which conventionally is used for grinding or cutting processes. Just for the sake of providing an example, such a material may be silicon carbide (referred to as 10C) having a medium hardness of the value "M" and a medium grain size of the value of 60 according to the specifications of DIN 69100.

According to an exemplary embodiment the upper surface of the blank contacting element is spherically shaped according to the target shape of a front surface of the lens blank to be contacted with the upper surface of the blank contacting element. In other words, the shape of the upper surface of the blank contacting element is chosen such that a lens blank sucked onto the upper surface necessarily is brought into the desired shape. Thus, the radius of curvature of the upper surface of the blank contacting element may be adapted to the radius of curvature of the front surface of the lens blank to be blocked. In case that the lens blanks to be blocked and contacted to the blank contacting element are equipped with a protective foil or coating, the thickness of the coating is optionally considered when choosing the radius of curvature of the spherically shaped upper surface. This ensures that a blocked lens blank, which typically exhibits some degree of mechanical elasticity, has and maintains the correct shape when blocked to the blocking piece. By doing so, possible spherical and/or cylindrical deviations of the lens blank from the desired shape can be avoided, which may for instance occur due to variations in the manufacturing process of the mold, during a polymerization process of the lens blank and/or during a tempering process of the lens blanks. A possible parallel change of shape of the front surface and back surface of the lens blank after unblocking, which may originate in remaining tensions in the polymeric material of the lens blank, is typically negligible for the optical properties of the resulting spectacle lens. The compensatable amount of spherical and/or cylindrical deviation due to the blocking process depends on the mechanical stability of the lens blank. Polymeric lens blanks typically have a convex front surface and a concave back surface, wherein the curvatures are chosen to ensure an almost constant material thickness over the entire lens blank. Typically used lens blanks made of the material CR39 or of a polyurethane-based high-index material have a thickness in the central area between 5 mm and 9 mm and a radius of curvature between 80 mm and 300 mm. Polymeric lens blanks having such a geometry may be globally changed in their shape by vacuum blocking according to an exemplary embodiment of the disclosure due to a suction force of up to 200 N by up to 70 μm in their sagittal height with a diameter of 65 mm. For thicker lens blanks this value is reduced due to the increased stability. A lens blank having a thickness of about 11 mm having a medium curvature radius may be subject to a global change of shape of about 50 μm in their sagittal height with a diameter of 65 mm. Therefore, the method for blocking a lens blank according to an optional exemplary embodiment comprises adapting the shape of the front surface of the lens blank to the shape of the upper surface of the blank contacting element by sucking the lens blank to the blank contacting surface.

Lens blanks, which are optimized regarding their thickness and, thus optimized regarding their manufacturing costs, benefit from a vacuum blocking process according to an exemplary embodiment of the disclosure, since it refrains from a heating and cooling process, which often alters the shape of the lens blank in an undesired manner. Even when applying a controlled cooling-off period over a time period of 30 min, such undesired deformations cannot be entirely avoided. Therefore, a vacuum blocking process according to an exemplary embodiment of the disclosure is particularly suitable for such lens blanks optimized regarding their thickness. A lens blank being optimized regarding its thickness is optimized such as to avoid a large thickness of the lens blank. The optimization may in particular include a suitable combination of the radius of curvature of the front surface of the lens blank and the radius of curvature of the individually adapted back surface resulting in the desired optical power while keeping the thickness of the lens blank at a minimum. Thus, for different optical powers to be realized at the back surface of a lens blank, a lens blank having a suitable radius of curvature at its front surface may be chosen, such that the total thickness of the lens blank can be kept as small as possible.

According to an exemplary embodiment, the outer dimensions of a peripheral surface and optionally a lower surface of the blank contacting element essentially corresponds to the inner dimensions of the upper part of the support element tightly enclosing the blank contacting element. In other words, the shape and size of the blank contacting element are optionally fitted to the inner dimensions of the upper part of the support element receiving the blank contacting element. This allows effectively sealing the peripheral surface of the blank contacting element. According to an exemplary embodiment the blank contacting element is adhesively attached to an inner surface of the upper part of the support element. This further tightens the sealing of the peripheral surface and optionally parts of the lower surface of the blank contacting element to ensure that the suction occurs via the upper surface and the lower surface or parts of the lower surface of the blank contacting element.

According to an exemplary embodiment, the support element comprises a vacuum reservoir being in fluidic communication with a lower surface and optionally with a peripheral surface of the blank contacting element. The fluid communication may be established by providing through holes in the part of the support element facing the lower surface of the blank contacting element such that the through holes connect the lower surface of the blank contacting element with the vacuum reservoir being arranged inside the support element underneath a support surface being in contact with the lower surface of the blank contacting element. The through holes, thus, may penetrate the support surface. Providing a vacuum reservoir may provide the advantage that the vacuum inside the blocking piece having a lens blank blocked to it may be maintained in a volume confined by the vacuum reservoir, inner walls of the support element and/or the sealed peripheral wall of the blank contacting element and the front surface of the blocked lens blank. In particular, the vacuum reservoir may allow maintaining the vacuum and the blocking of the lens blank by the vacuum even after disconnecting an external vacuum source.

According to an exemplary embodiment, the blocking piece and in particular the support element of the blocking piece comprises a valve for carrying out one or more of the following actions: evacuating the vacuum reservoir, maintaining the vacuum in the vacuum reservoir, and venting the vacuum reservoir. The valve allows connecting the vacuum reservoir with a vacuum source for evacuating the vacuum reservoir to block a lens blank by generation a suction sucking the lens blank against the upper surface of the blank contacting surface. The vacuum source may comprise a Venturi nozzle operated with a conventional compressed air system. By applying a conventional compressed air system providing a pressure of 6 bar above the atmospheric pressure, the connected Venturi nozzle is easily capable of provide a vacuum of 0.75 to 0.9 bar below the atmospheric pressure, i.e., an absolute pressure of about 0.1 to 0.25 bar. The valve further allows releasing the blocked lens blank by venting the reservoir to break the vacuum. Therefore, the valve allows providing the vacuum and blocking the lens blank by connecting the vacuum reservoir to the vacuum source, maintaining the vacuum in the vacuum reservoir when disconnected from the vacuum source by keeping the valve closed, and venting the vacuum reservoir by opening the valve when disconnected from the vacuum source.

According to an exemplary embodiment, the valve is adapted as a spring-loaded valve remaining in a closed state unless being activated by counteracting the spring force. This allows maintaining the vacuum after disconnecting the blocking piece from the vacuum source and facilitates the disconnecting process from the vacuum source since the spring will automatedly close the valve. The blocking piece may be adapted such that the valve opens automatedly when the blocking piece is connected to the vacuum source. For opening the valve to intentionally break the vacuum and vent the vacuum reservoir, a manual or automated action may be required.

According to an exemplary embodiment the lower part of the support element comprises an engagement element for engaging the support element with a clamping device, wherein the engagement element optionally comprises a conical protrusion having a peripheral recess for providing a force-fitting and form-fitting engagement of the engagement element with the clamping device. The blocking element and particularly the lower part of the support element may be adapted to the structural properties of conventional blocking pieces. This allows using a blocking piece according to an exemplary embodiment with conventional clamping devices. The blocking piece may be adapted according to the standard DIN 58766. The peripheral recess may provide a form-fitting fixation of the blocking piece with the clamping device in addition to a force-fitting fixation.

According to an exemplary embodiment the upper part and the lower part of the support element are provided as a single piece or as separate parts attached to each other. The support element is optionally at least partly made of one or more of the following metallic material: aluminum, an aluminum alloy, stainless steel. In particular, the support element is made of a fluid-tight material in those parts, which tightly enclose and seal the bank contacting element against a fluid flow. When the support element comprises more than one pieces, the pieces may be attached to each other by screws or any other fixation means.

According to an exemplary embodiment the support element further comprises an identification element providing information for identifying the blocking piece, wherein the information provided by the identification element is accessible from outside the blocking piece; and wherein optionally the identification element may comprise or consist of one or more of the following items: a bar code, a quick response code (QR-code); a human-readable inscription; and a radio-frequency identification (RFID) chip. This allows an identification of the blocking piece and/or the lens blank blocked to the blocking piece and, thus, facilitates the correct assignment of the lens blank to the manufacturing steps. The identification element may allow a manual identification by a user without any technical equipment, for instance my means of an inscription, and/or may allow an automated identification and/or an identification by means of a reading device, such as a bar code reader and/or an RFID reading device. Moreover, the blocking piece may comprise a memory element, which may be separate or combined with the identification element, for storing information, such as information about the blocked lens blank. The stored information may be prescription data, a serial or manufacturing number and/or other information related to the manufacturing process of the lens blank and the final spectacle lens.

According to an exemplary embodiment, the blocking piece comprises one or more sealing lips at the periphery of the blocking piece to assist with providing the vacuum within the blocking piece and between the lens blank and the upper surface of the blank contacting element. The sealing lips may contribute to sealing the void formed by the vacuum reservoir, the support element and the front surface of a blocked lens blank. The sealing lips may additionally seal the edge at the interface between the lens blank and the blank contacting element. This, however, does not set aside the requirement that the lens blank is contacted to essentially the entire upper surface of the blank contacting element.

According to an exemplary embodiment a suction force of the applied vacuum sucking the lens blank to the upper surface of the blank contacting element has a strength of at least 80 N. Optionally, the suction force has a value between 150 N and 250 N. This results in a blocking of a lens blank to the blocking piece with sufficient strength and stability to carry out the intended manufacturing processes for providing the prescribed optical power to the back surface of the lens blank. Furthermore, the strength is suitable for deforming the lens blank to adapt to the shape of the upper surface of the blank contacting element. The strength is, however, in a range to avoid damages of the lens blank, such as irreversible deformations and/or scratches to the front surface.

According to an exemplary embodiment, the lens blank is provided with a protective foil at the surface facing the blank contacting element, the protective foil increasing the friction coefficient as compared to the friction coefficient of the surface of the lens blank not having the protective foil. Thus, in addition to the effect of protecting the foil against damages and contaminations, the foil may increase the friction coefficient and, thus, reduce the risk of an undesired relative sliding movement of the blocked lens blank with respect to the blocking piece. In addition, the protective foil may provide the advantage that local pressure maxima of the pressure pressing the lens blank to the upper surface of the blank contacting element may be reduce, since the pressure may be distributed more evenly due to a local deformation of the foil. Thus, a protective foil may be chosen to have a suitable hardness, thickness, and surface roughness. For example, a glass protection foil provided by the company LOHMANN in Germany having a thickness of 0.1 mm may be a suitable choice for blocking applications.

According to an exemplary embodiment the friction coefficient of the front surface of the lens blank or the protective foil, respectively, may be further increased by applying an adhesive spray to the front surface of the lens blank or the protective foil. Such an adhesive spray consists of microscopically small droplets adhering to the front surface and typically drying within few seconds. By this measure, the friction coefficient may by significantly increased. As an example, by such an adhesive spray the friction coefficient may be increased to a value of about 2.8 as compared to about 0.35 to 0.4 for an untreated upper surface of aluminum oxide or an untreated protective foil. The adhesive spray may be removed after deblocking together with the protective foil, or in absence of a foil, can be removed without residues. For example, a single component adhesive spray provided by the company E-COLL may provide suitable results. Alternatively or additionally, a material having a high surface roughness may be chosen as blank contacting element, such as silicon carbide having an upper surface treated by a grinding process, which may in combination with an (untreated) protective foil provide an interlocking effect between the lens blank and the upper surface, which reduces the risk of an undesired relative movement of the lens blank relative to the blocking piece.

According to an exemplary embodiment the method further comprises refreshing the vacuum in the vacuum reservoir. Such a refresh may be carried out regularly, as long as a lens blank is blocked to the blocking piece. Alternatively or additionally, the refresh may be carried out directly before carrying out a manufacturing step, such as a machining step. This allows to ensure that the suction force is fully restored when commencing a manufacturing step coming along with a high mechanical impact on the lens blank.

Various blocking pieces having different radii of curvatures of their upper surface may be provided. This allows manufacturing different spectacle lenses based on lens blanks having different radii of curvature on their front surface. In other words, for lens blanks having different radii of curvature, separate blocking pieces may be provided having the corresponding radius of curvature at the upper surface of their blank contacting element.

In order to enable prismatic blocking, the spherical surface of the vacuum adapter may be manufactured with a defined pre-sloped upper surface of the blank contacting element. The slope may have a defined pre-inclination, i.e., the normal at the center of the upper surface of the blank contacting element has a defined inclination with respect to the central axis of the lower part, i.e., of the support element of the blocking piece. The prismatic effects commonly used in the field of ophthalmic optics are in a range between 0° and 10°, whereby more than 80% of all manufactured lenses have a prismatic effect in the range below 2°. The demand decreases rapidly for lenses having a larger prismatic effect. According to the state of the art, for the shaping of aspherical and/or progressive lenses, but also spherical and cylindrical optical lenses from plastic materials, a high-precision grinding process (high-speed cutting) is used with a diamond tool. Such a process may require that the surface in the center of the finished spectacle lens has a horizontal tangent, i.e., a surface perpendicular to the axis of rotation. Not fulfilling this condition may result an unwanted penetration of the tool cutting edge into the spectacle lens resulting in a geometric center defect. Due to a polishing process that typically follows the cutting or grinding operation, it is possible in principle to use conventional diamond tool radii to produce an optical lens with a surface that deviates by up to about 1.5° from the horizontal in the center in the turning process free of form errors. Based on this condition, it is typically possible to cover the relevant prismatic effect range between 0° and 6° with two different vacuum blocking pieces. Here, for example, the range of lenses with a prismatic effect between 0° and 3° may be produced with a blocking piece having a tilted surface normal of 1.5°. The range between 3° and 6° may be produced using a blocking piece having a tilted surface normal of 4.5°.

It is understood by a person skilled in the art that the above-described features and the features in the following description and drawings are not only disclosed in the explicitly disclosed exemplary embodiments and combinations, but that also other technically feasible combinations as well as the isolated features are comprised by the disclosure of the disclosure. In the following, several exemplary embodiments of the disclosure and specific examples of the disclosure are described with reference to the drawings for illustrating the disclosure without limiting the disclosure to the described exemplary embodiments.

BRIEF DESCRIPTION OF THE DRAWINGS

The disclosure will now be described with reference to the drawings wherein.

DESCRIPTION OF EXEMPLARY EMBODIMENTS

Figure 1A:
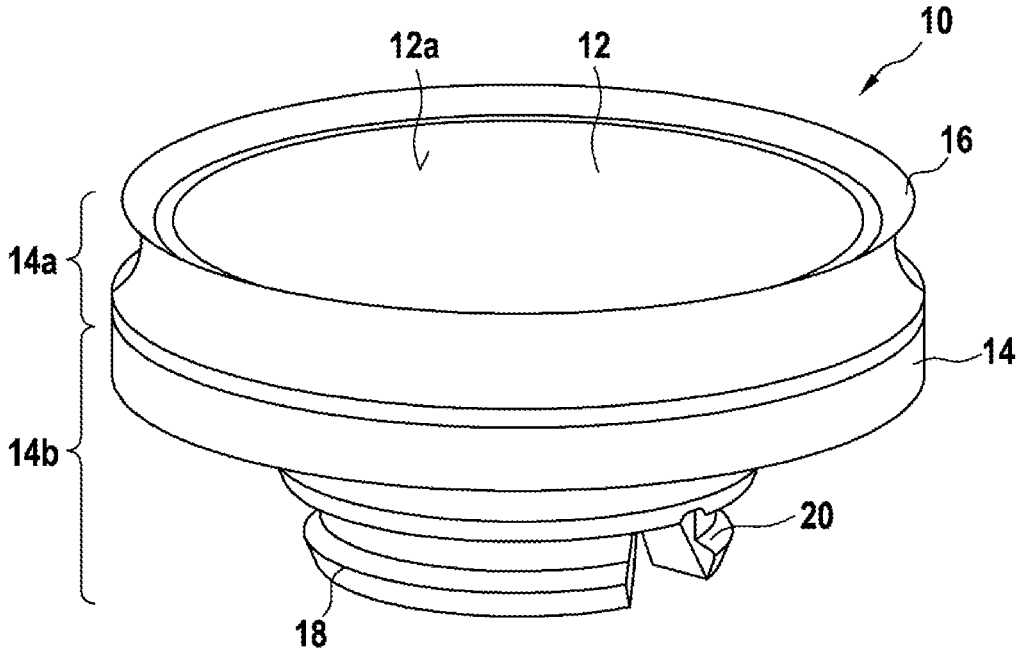
FIGS. 1A and 1B show a blocking piece according to an exemplary embodiment in a perspective view and in a cross-sectional view.

In the drawings the same reference signs are used for corresponding or similar features in different drawings.

Figure 1B:
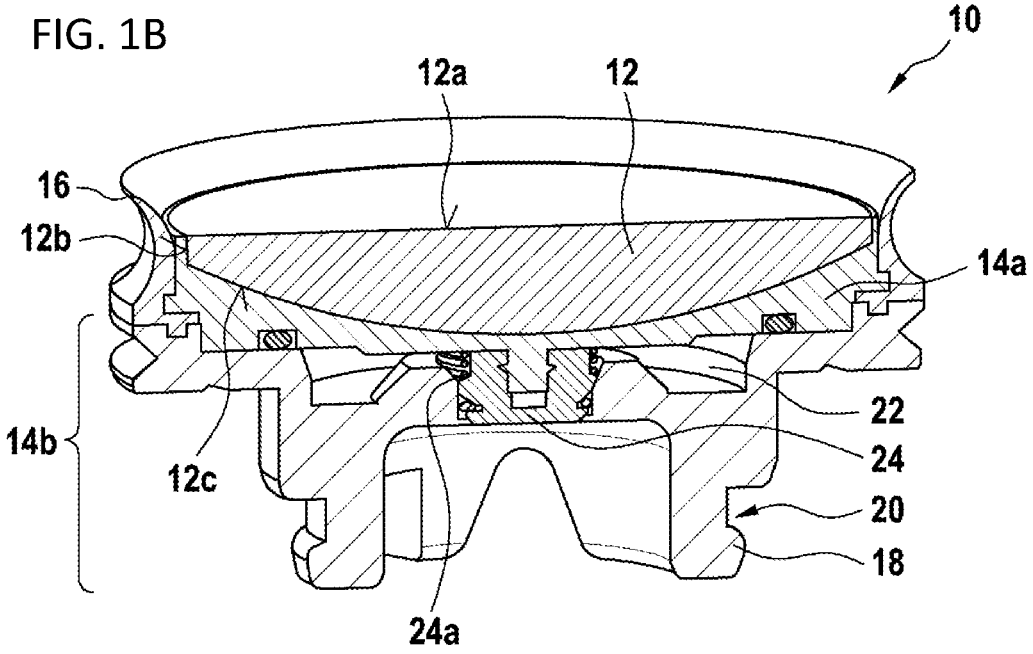

FIGS. 1A and 1B show a perspective view (FIG. 1A) and a cross-sectional view (FIG. 1B) of a blocking piece 10 according to an optional exemplary embodiment for vacuum blocking a lens blank. The blocking piece 10 comprises a blank contacting element 12 formed of a rigid fluid-permeable material and having an upper surface 12*a* for contacting a front surface of a lens blank. The blocking piece 10 further comprises a support element 14 having an upper part 14*a* and a lower part 14*b*. The upper part 14*a* of the support element 14 tightly encloses the peripheral blank contacting element 12, wherein the upper part 14*a* is partly covered by a sealing lip 16 of the blocking piece 10. The lower part 14*b* of the support element 14 is adapted to engage with a clamping device and comprises for this purpose an engagement element 18. The engagement element 18 is adapted to engage a respective counter part of a clamping device of a machine for machining the back side of the lens blank. A peripheral recess 20 of the engagement element provides a form-fitting and force-fitting engagement with the clamping device (not shown). According to this exemplary embodiment, the engagement element 18 is identical to an engagement element of a conventional blocking piece to ensure full compatibility with conventional clamping devices and/or blocking devices. This allows replacing conventional blocking pieces with a blocking piece 10 according to the presented exemplary embodiment.

According to the presented exemplary embodiment, the upper surface 12*a* has a radius of curvature which is adapted to the radius of curvature of a lens blank to be blocked. If the lens blanks to be blocked are typically equipped with a protective foil or coating on their front surface, the thickness of the protective foil or coating may be considered at the radius of curvature of the upper surface 12*a*.

The blank contacting element 12 is made of a rigid and fluid-permeable material. According to the presented exemplary embodiment the blank contacting element 12 is formed of a porous material, such as aluminum oxide, having an open porosity between 10% and 15%. This choice of material ensures a sufficient rigidity to avoid a deformation of the blank contacting element 12 when applying a vacuum and sucking a lens blank to the upper surface 12*a*. On the other hand, the open porosity ensures the ability of the blank contacting element 12 to enable a fluid flow, i.e., a fluid permeability, required for generating the suction to suck the lens blank to the upper surface.

FIG. 1B shows a cross-sectional view of the blocking piece 10 revealing inter alia a peripheral wall 12*b* and a lower surface of the blank contacting element 12. The peripheral wall 12*b* is tightly enclosed by the upper part 14*a* of the support element 14 to prevent a fluid stream entering or exiting the peripheral wall 12*b*. Also, the lower surface 12*c* of the blank contacting element 12 is enclosed by the upper part 14*a* of the support element 14, wherein the upper part 14*a* comprises one or more through holes to enable a fluidic connection between the lower surface 12*c* of the blank contacting element 12 and a vacuum reservoir 22 arranged underneath the upper part 14*a* of the support element 14. Via the one or more through holes and the open porosity of the blank contacting element 12 a suction can be generated from the upper surface 12*a* of the blank contacting element 12 through the bulk body of the blank contacting element 12 to the vacuum reservoir 22 and a vacuum source (not shown), which may be connected to the vacuum reservoir 22. For the sake of illustration, the blank contacting element 12 may be considered as a diffusor for the suction generated by a vacuum source underneath the upper part 14*a* of the support element.

The blocking piece moreover comprises a valve 24 attached to the vacuum reservoir 22 allowing evacuating the vacuum reservoir 22 by opening the valve 24 and connecting it to a vacuum source (not shown). The valve 24 is a spring-loaded valve prevailing in a closed state unless the spring force is overcome by a force impact for opening the valve 24. The spring 24*a* of the spring-loaded valve 24 is exemplarily indicated. Similarly, the valve 24 may be used for venting the vacuum reservoir 22 to break the vacuum and unblocking a blocked lens blank. This may be achieved by opening the valve while the blocking piece 10 and in particular the valve 24 is disconnected from the vacuum source 24.

The sealing lip 16 is attached at the periphery of the upper part 14*a* of the support element 14 enclosing the blank contacting element 12. The sealing lip 16 assists contacting the lens blank in an airtight manner to facilitate the establishment of a vacuum in the void formed by the vacuum reservoir 22, the through holes(s) in the support element 14, the open pores of the blank contacting element 12 and a possible remaining local gap between the front surface of the lens blank and the periphery of the blank contacting element 12. However, the sealing lip 16 merely serves the purpose of assisting an airtight sealing but does not refrain the lens blank from contacting the entire upper surface 12*a* of the blank contacting element 12.

FIG. 1B further illustrates that the support element 14 according to the presented exemplary embodiment is made of several separate parts. These parts comprise the upper part 14*a*, the lower part 14*b* and the valve 24. Such a composition of several elements facilitates the manufacturing of various different blocking pieces, such as blocking pieces having different blank contacting elements 12. For this purpose, different upper parts 14*a* may be provided, which are each adapted to one or more of the various different blank contacting elements 12.

Figure 2:
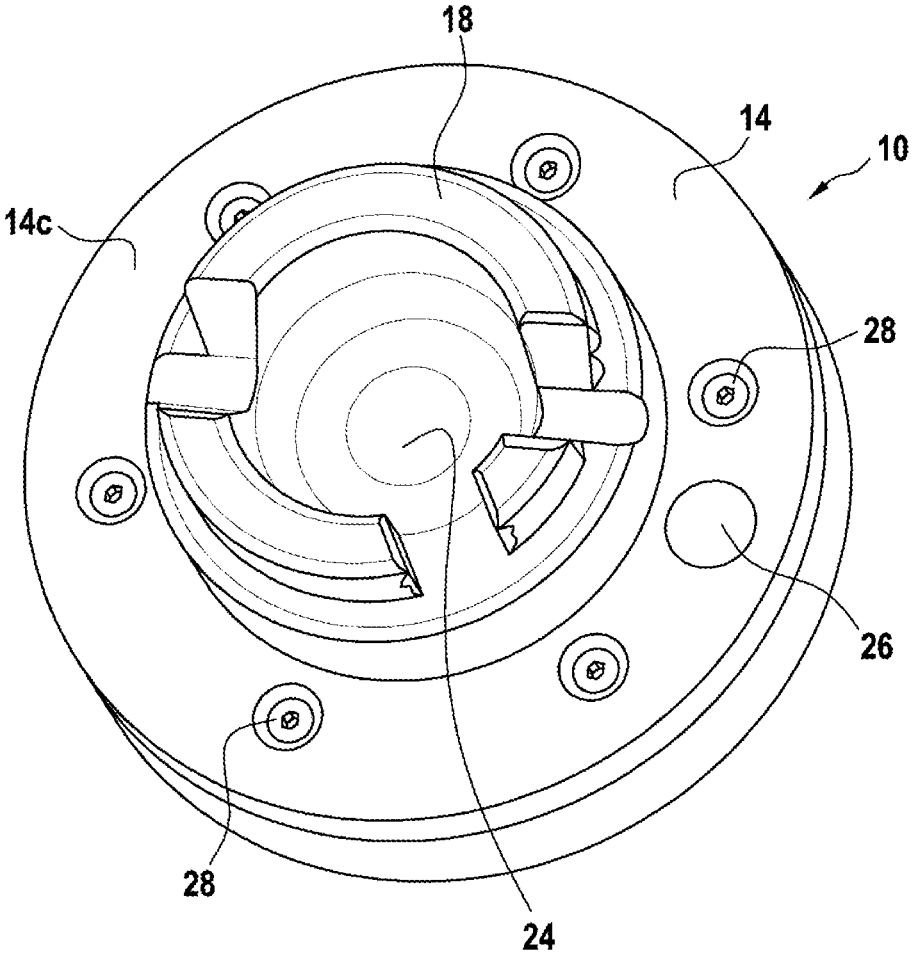
FIG. 2 depicts a blocking piece according to an exemplary embodiment in a bottom view.

FIG. 2 depicts a perspective bottom view of the blocking piece 10 according to the blocking piece 10 presented in FIGS. 1A and 1B. The bottom view reveals the valve 24 arranged in the center of the support element 14 and concentrically with the engagement element 18. In addition, FIG. 2 reveals an identification element 26 attached at the lower surface 14*c* of the support element 14. The identification element may comprise a transponder, such as a RFID transponder, which may be read or written with a conventional RFID sender and receiver. The identification element 26 may be used for storing information concerning the blocking piece 10 and/or concerning a lens blank blocked to the blocking piece 10, such as prescription data to be applied to the lens blank and/or information for identifying the order or serial number of the spectacle lens to be manufactured. Alternatively, or additionally the identification element may comprise other kinds of identification means, such as a bar code and/or a QR code and/or an inscription readable for humans. Moreover, the bottom view depicts several screws 28 fixing the upper and lower part 14*a*, 14*b* of the support element to each other.

Figure 3A:
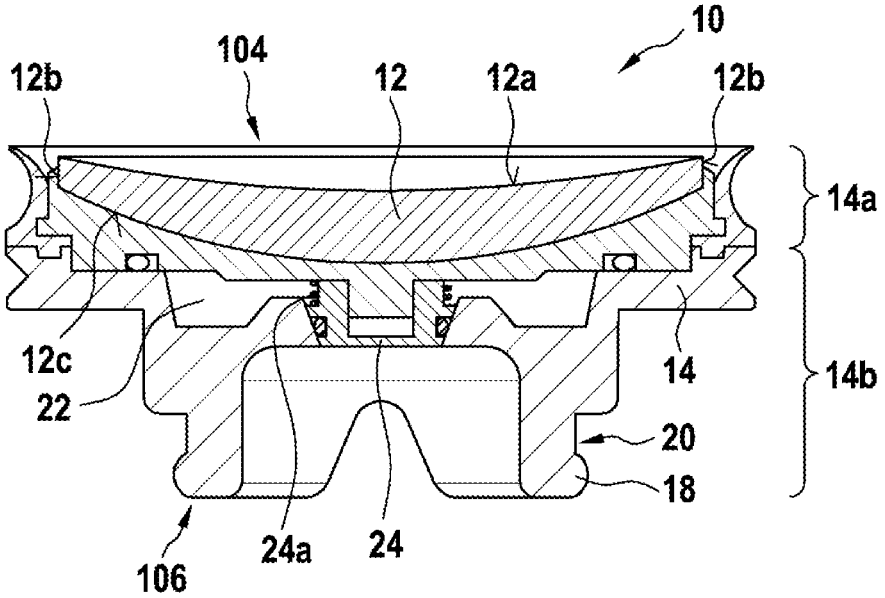
FIGS. 3A and 3B depict a blocking piece according to an exemplary embodiment with and without a lens blank blocked to it.
Figure 3B:
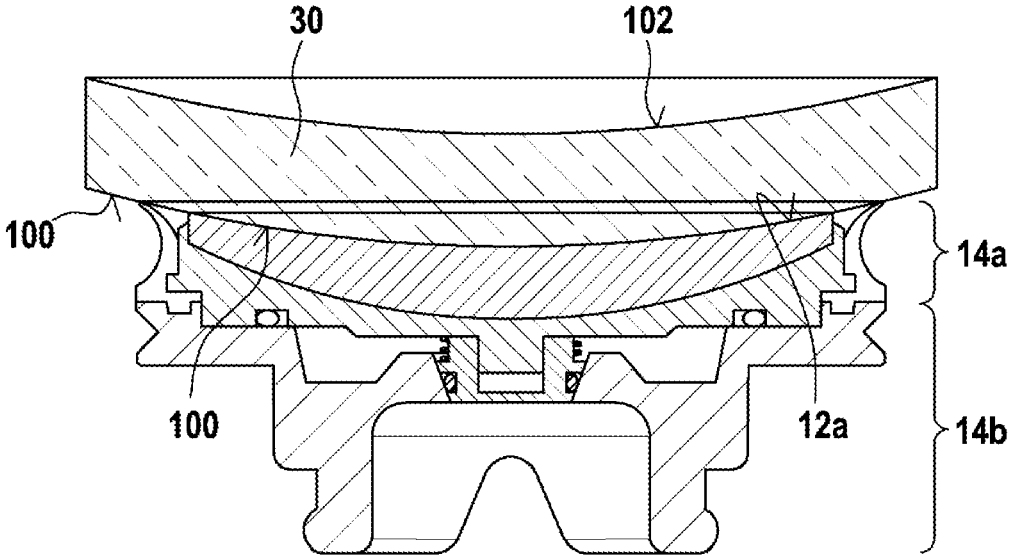

FIGS. 3A and 3B depict a blocking piece according to the optional exemplary embodiment shown in FIGS. 1A and 1B without a lens blank blocked to the blocking piece 10 (FIG. 3A) and with a lens blank 30 being blocked to the blocking piece 10. As can be seen in FIG. 3B, the blocked lens blank 30 is blocked to the blocking piece such that the front surface 100 of the lens blank is in contact with the entire upper surface 12*a* of the blank contacting element 12. The lens blank 30 is blocked to the blocking piece 10 by a vacuum provided in the vacuum reservoir 22, which generates a suction force to the lens blank 30 through the porous blank contacting element against the upper surface 12*a* of the blank contacting element 12.

FIG. 3A further illustrates the reference directions used throughout this document regarding the blocking piece 10 and the lens blank 30. These are the front surface 100 and the back surface 102 of the lens blank 30, the upper side 104 and lower side 106 of the blocking piece 10, the upper part 14*a* and the lower part 14*b* of the support element 14, as well as the upper surface 12*a*, the peripheral surface 12*b* and the lower surface 12*c* of the blank contacting element 12. These directions and parts shall be indicated by the respective names although, depending on the orientation of the blocking piece 10 in the three-dimensional space, may not always result in the upper side being oriented in an upward direction according to the common understanding. The directions in this description are merely provided for illustrative purposes.

In the following, a method according to an optional exemplary embodiment of the disclosure for blocking a lens blank to a blocking piece according to a preferred exemplary embodiment is exemplary illustrated.

For blocking a lens blank, a clamping device is used to which the vacuum blocking piece is mechanically clamped. The valve is opened automatedly during the clamping process. The blocking device has a centering stop suitable for the respective blank diameter. The vacuum may be generated by means of a Venturi nozzle connected to a compressed air system, such as a compressed air system commonly used in industry delivering air at a pressure of about 6 bar. This allows generating a vacuum of about 0.8 bar, which corresponds to an absolute pressure of about 0.2 bar. The spherical front surface of the lens blank, which may have been cast or machined, is covered with a protective foil or a coating, is placed on the spherical upper surface of the blank contacting element of the blocking piece clamped in the clamping device, centered with the aid of a centering stop, and the vacuum is then switched on. The vacuum causes the lens blank to contact the upper surface of the blank contacting element, moving it onto the sealing lip on the peripheral side of the blocking piece and thus sealing the system from the outside, wherein the lens blank is tightly attached to essentially the entire upper surface of the blank contacting element. A spring-loaded mechanism then closes the valve of the blocking piece. The blocked lens blank is not fixed to the blocking piece and can now be removed from the clamping device together with the blocking piece. In the event of an unforeseen loss of vacuum, for example due to long downtimes in the production environment, rest periods at the weekend or similar, the vacuum can simply be replenished in a processing machine or in a special device made for this purpose.

To detach, i.e., to unblock the spectacle lens processed from the lens blank from the vacuum blocking piece, the valve of the blocking piece is opened inside an unblocking device, thus ventilating the vacuum reservoir of the blocking piece. This process of ventilation can be forced by supplying compressed air. It is also possible to detach the spectacle lens from the block piece by blowing focused compressed air from the outside between the front surface of the spectacle lens and the sealing lip and upper surface using a nozzle. In principle, the unblocking process described can also be carried out in the same device that is used for the blocking process. In this case, in addition to the "evacuate" function, a "ventilate" function can be provided, which can then be activated by means of a pneumatic switching device.

The foregoing description of the exemplary embodiments of the disclosure illustrates and describes the present invention. Additionally, the disclosure shows and describes only the exemplary embodiments but, as mentioned above, it is to be understood that the disclosure is capable of use in various other combinations, modifications, and environments and is capable of changes or modifications within the scope of the concept as expressed herein, commensurate with the above teachings and/or the skill or knowledge of the relevant art.

The term "comprising" (and its grammatical variations) as used herein is used in the inclusive sense of "having" or "including" and not in the exclusive sense of "consisting only of." The terms "a" and "the" as used herein are understood to encompass the plural as well as the singular.

All publications, patents and patent applications cited in this specification are herein incorporated by reference, and for any and all purposes, as if each individual publication, patent or patent application were specifically and individually indicated to be incorporated by reference. In the case of inconsistencies, the present disclosure will prevail.

LIST OF REFERENCE SIGNS

10 blocking piece
12 blank contacting element
12*a* upper surface of blank contacting element
12*b* peripheral surface of blank contacting element
12*c* lower surface of blank contacting element
14 support element
14*a* upper part of support element
14*b* lower part of support element
14*c* lower surface of support element
16 sealing lip
18 engagement element
20 peripheral recess of engagement element
22 vacuum reservoir
24 valve
24*a* spring of the spring-loaded valve
26 identification element
28 screw
30 lens blank
100 front surface of lens blank
102 back surface of lens blank
104 upper side of blocking piece
106 lower side of blocking piece

The invention claimed is:

1. A blocking piece for vacuum blocking a lens blank, the blocking piece comprising:

a blank contacting element formed of a rigid fluid-permeable material having an upper surface for contacting the lens blank and a peripheral surface adjacent to the upper surface; and a support element having an upper part tightly enclosing the blank contacting element on the peripheral surface of the blank contacting element and a lower part configured to engage with a clamping device for clamping the blocking piece, wherein the blocking piece is configured to fix the lens blank to the upper surface of the blank contacting element by applying a vacuum within the blocking piece to provide a suction through essentially the entire upper surface of the blank contacting element to suck the lens blank to the upper surface of the blank contacting element, wherein the blocking piece further comprises a sealing lip at an outer periphery of the upper part of the support element and extending radially outward from the outer periphery of the upper part of the support element and configured to assist with providing the vacuum within the blocking piece and between the lens blank and the upper surface of the blank contacting element, wherein the sealing lip is a separate component from the support element, and wherein the sealing lip also extends in a direction parallel to the outer periphery of the upper part of the support element to a height above the upper surface for contacting the lens blank.

2. The blocking piece according to claim 1, wherein the rigid fluid-permeable material comprises or consists of a rigid porous material having an open porosity.

3. The blocking piece according to claim 1, wherein the rigid fluid-permeable material comprises or consists of one or more of the following materials: ceramic materials, carbide materials, in particular silicon carbide, oxide materials, in particular aluminum oxide, and aluminum foam.

4. The blocking piece according to claim 1, wherein the upper surface of the blank contacting element is spherically shaped according to a target shape of a front surface of the lens blank to be contacted with the upper surface of the blank contacting element.

5. The blocking piece according to claim 1, wherein outer dimensions of the peripheral surface and optionally a lower surface of the blank contacting element essentially correspond to inner dimensions of the upper part of the support element tightly enclosing the blank contacting element.

6. The blocking piece according to claim 1, wherein the support element comprises a vacuum reservoir being in fluidic communication with a lower surface of the blank contacting element and optionally with the peripheral surface of the blank contacting element.

7. A lens blank and the blocking piece according to claim 1, wherein the blocking piece is blocking the lens blank by applying a vacuum within the blocking piece to suck the lens blank to the blank contacting element formed of the rigid fluid-permeable material.

8. The blocking piece according to claim 5, and wherein the blank contacting element is adhesively attached to an inner surface of the upper part of the support element.

9. The blocking piece according to claim 6, wherein the support element comprises a valve for carrying out one or more of the following actions:

evacuating the vacuum reservoir, and venting the vacuum reservoir.

10. The blocking piece according to claim 9, wherein the valve is configured as a spring-loaded valve remaining in a closed state unless being activated by counteracting a spring force of the spring-loaded valve.

11. The blocking piece according to claim 1, wherein the lower part of the support element comprises an engagement element for engaging the support element with a clamping device.

12. The blocking piece according to claim 1, wherein the upper part and the lower part of the support element are provided as a single piece or as separate parts attached to each other; and wherein the support element is at least partly made of one or more of the following metallic material: aluminum, an aluminum alloy, and stainless steel.

13. The blocking piece according to claim 1, wherein the support element further comprises an identification element providing information for identifying the blocking piece, wherein the information provided by the identification element is accessible from outside the blocking piece, and wherein optionally the identification element may comprise or consist of one or more of the following items: a bar code, a QR-code, a human-readable label, and an RFID chip.

14. The blocking piece according to claim 11, wherein the engagement element comprises a conical protrusion having a peripheral recess for providing a tight fitting and form fitting engagement of the engagement element with the clamping device.

15. A blocking piece for vacuum blocking a lens blank, the blocking piece comprising:

a blank contacting element formed of a rigid fluid-permeable material having an upper surface for contacting the lens blank and a peripheral surface adjacent to the upper surface; and a support element having an upper part tightly enclosing the blank contacting element on the peripheral surface of the blank contacting element and a lower part configured to engage with a clamping device for clamping the blocking piece, wherein the blocking piece is configured to fix the lens blank to the upper surface of the blank contacting element by applying a vacuum within the blocking piece to provide a suction through essentially the entire upper surface of the blank contacting element to suck the lens blank to the upper surface of the blank contacting element, wherein the blocking piece further comprises a sealing lip at an outer periphery of the upper part of the support element and extending radially outward from the periphery of the upper part of the support element and configured to assist with providing the vacuum within the blocking piece and between the lens blank and the upper surface of the blank contacting element, and wherein the upper surface of the blank contacting element is configured to deform the lens blank to adapt to a shape of the upper surface of the blank contacting element.

16. A method for blocking a lens blank to a blocking piece, the method comprising:

providing a blocking piece having a blank contacting element formed of a rigid fluid-permeable material and a support element with an attached sealing lip extending radially outward at a peripheral side of the support element, the blank contacting element having an upper surface for contacting the lens blank and a peripheral surface adjacent to the upper surface, wherein the blank contacting element is tightly enclosed by the support element on the peripheral surface of the blank contacting element;

arranging a lens blank at the upper surface of the blank contacting element such that the lens blank entirely covers the upper surface;

applying a vacuum within the blocking piece to provide a suction through the rigid fluid-permeable material sucking the lens blank to the entire upper surface of the blank contacting element; and moving the lens blank onto the sealing lip on the peripheral side of the blocking piece such that the sealing lip seals the blocking piece and the lens blank from an outside, wherein the sealing lip is a separate component from the support element, and wherein the sealing lip also extends in a direction parallel to the outer periphery of the upper part of the support element to a height above the upper surface for contacting the lens blank.

17. The method according to claim 16, wherein a suction force of the applied vacuum sucking the lens blank to the upper surface of the blank contacting element has a strength of at least 80 N.

18. The method according to claim 16, wherein the lens blank is provided with a protective foil at the front surface facing the blank contacting element, the protective foil increasing a friction coefficient as compared to the friction coefficient of the front surface of the lens blank not having the protective foil.

* * * * *